US010224644B1

(12) United States Patent
Park et al.

(10) Patent No.: US 10,224,644 B1
(45) Date of Patent: Mar. 5, 2019

(54) SERIES-FED E-SHAPED PATCH ANTENNA ARRAY WITH CO-POLARIZED PARASITIC PATCHES

(71) Applicant: Korea Advanced Institute of Science and Technology, Daejeon (KR)

(72) Inventors: Chul-Soon Park, Daejeon (KR); Tae-Hwan Jang, Daejeon (KR); Hong-Yi Kim, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 0 days.

(21) Appl. No.: 15/805,558

(22) Filed: Nov. 7, 2017

(30) Foreign Application Priority Data

Aug. 30, 2017 (KR) ..... 10-2017-0109848

(51) Int. Cl.
*H01Q 21/06* (2006.01)
*H01Q 21/00* (2006.01)
*H01Q 9/04* (2006.01)

(52) U.S. Cl.
CPC ..... *H01Q 21/065* (2013.01); *H01Q 21/0075* (2013.01); *H01Q 9/0421* (2013.01)

(58) Field of Classification Search
CPC ..... H01Q 21/00–21/065; H01Q 1/38
USPC ..... 343/700 MS, 824, 893
See application file for complete search history.

(56) References Cited

U.S. PATENT DOCUMENTS 5,576,718 A * 11/1996 Buralli ..... H01Q 19/005 343/700 MS
6,320,542 B1 * 11/2001 Yamamoto ..... H01Q 1/38 343/700 MS
2015/0155636 A1 * 6/2015 Maruyama ..... H01Q 19/30 343/730

* cited by examiner

*Primary Examiner* — Dameon E Levi
*Assistant Examiner* — Hasan Z Islam
(74) *Attorney, Agent, or Firm* — Daly, Crowley Mofford & Durkee, LLP

(57) ABSTRACT

A series-fed E-shaped patch antenna array has co-polarized parasitic patches to improve aperture efficiency. Each of microstrip parasitic patches is inserted between a plurality of microstrip E-shaped patch antennas. The parasitic patches are co-polarized with the E-shaped patch antennas so that the current flows in the parasitic patches and the E-shaped patch antennas have the same polarity. Additional radiation from the co-polarized microstrip parasitic patches significantly improves gain flatness, gain and aperture efficiency due to offset resonance frequency.

14 Claims, 10 Drawing Sheets

SERIES-FED E-SHAPED PATCH ANTENNA ARRAY WITH CO-POLARIZED PARASITIC PATCHES

CROSS-REFERENCE TO RELATED APPLICATION

This U.S. non-provisional application claims priority under 35 USC § 119 from Korean Patent Application No. 10-2017-0109848, filed on Aug. 30, 2017 in the Korean Intellectual Property Office (KIPO), the disclosure of which is hereby incorporated by reference in its entirety.

BACKGROUND

1. Technical Field

The present invention relates to an antenna technology field, and more particularly, to a patch antenna.

2. Description of the Related Art

For example, The 60 GHz international unlicensed band as wide as 57-66 GHz is being commercialized for several-Gb/s high data-rate communication and ultrahigh definition video streaming. For this frequency band, one of the key research topics is to develop a high gain antenna array that can mitigate the severe path loss during propagation in the air.

In general, many designs proposed to date to address this issue are composed of multilayered substrate including low temperature co-fired ceramic (LTCC). The multilayer substrate is more complicated in the production process than the single layer substrate, and thus has a high manufacturing cost. The antenna designs using such a multilayer substrate has serious drawbacks in that they incur high manufacturing costs and require a complex antenna structure.

Also, gain flatness over the wide unlicensed band is an important factor for wireless communication with high order linear modulation. However, most 60 GHz antennas have poor gain flatness over 3 dB in the 60 GHz unlicensed band.

SUMMARY

The present invention has been made under the recognition of the above-mentioned problems of the conventional art. It is an object of the present invention to provide a simple structure patch antenna based on an area-efficient antenna array with a wide flat gain bandwidth.

The present invention is not limited to the above-mentioned object, but may be variously modified without departing from the spirit and scope of the present invention.

According to an aspect of the present invention, there is provided a series-fed E-shaped patch antenna array with co-polarized parasitic patches according to embodiments for realizing the object of the present invention, which includes a dielectric antenna substrate, an antenna array, a microstrip feed line, and one or more microstrip parasitic patches. The antenna array includes a plurality of microstrip E-shaped patch antennas laminated on an upper surface of the antenna substrate and disposed in a line at predetermined intervals along a power feeding direction. The microstrip feed line is laminated on the upper surface of the antenna substrate, and serially connects the plurality of microstrip E-shaped patch antennas so that serial feeding is performed. The one or more microstrip parasitic patches are laminated on the upper surface of the antenna substrate and disposed between the plurality of microstrip E-shaped patch antennas so as to be co-polarized with the plurality of microstrip E-shaped patch antennas.

In exemplary embodiments of the present invention, the one or more microstrip parasitic patches may be co-polarized with the plurality of microstrip E-shaped patch antennas so that current flows in the one or more microstrip parasitic patches have the same polarity, i.e., the same phase as current flows in the plurality of microstrip E-shaped patch antennas.

In exemplary embodiments of the present invention, the one or more microstrip parasitic patches may be disposed in empty areas between the plurality of microstrip E-shaped patch antennas so as not to cause an increase in the overall antenna area due to placement of the one or more microstrip parasitic patches.

In exemplary embodiments of the present invention, the microstrip parasitic patches may be symmetrically disposed in two rows on the left and right sides with respect to the microstrip feed line.

In exemplary embodiments of the present invention, the antenna substrate may be a single-layer substrate.

In the exemplary embodiments of the present invention, each of the plurality of microstrip E-shaped patch antennas has an E-shaped structure in which two rectangular notches are formed in the feed side edges of rectangular microstrip patches on right and left sides of the microstrip feed line.

In exemplary embodiments of the present invention, the predetermined intervals between the plurality of microstrip E-shaped patch antennas may be equal to an effective wavelength $\lambda_{eff}$ at a dielectric constant of a medium. The length $L_0$ of each of the plurality of microstrip E-shaped patch antennas may be $L_0=\lambda_{eff}/2$, and the length $L_P$ of each of the one or more microstrip parasitic patches in the power feeding direction may be $L_P<\lambda_{eff}/2$.

In exemplary embodiments of the present invention, a resonance frequency $f_0+\Delta f$ of each of the one or more microstrip parasitic patches may be higher than a resonance frequency $f_0$ of the plurality of microstrip E-shaped patch antennas.

In exemplary embodiments of the present invention, the effective wavelength $\lambda_{eff}$ may be determined by $\lambda_{eff}=c/(f_0\cdot\varepsilon_r)$. Here, c is the light velocity, $f_0$ is the frequency in air, and $\varepsilon_r$ is the dielectric constant of the medium.

In exemplary embodiments of the present invention, the one or more microstrip parasitic patches may provide additional radiation in addition to radiation by the plurality of microstrip E-shaped patch antennas to secure an offset resonance frequency.

According to another aspect of the present invention, there is provided a serial-fed E-shaped patch antenna array with a co-polarized parasitic patch according to embodiments of the present invention, which includes an antenna substrate which is a single layer substrate made of a dielectric material having a high dielectric constant, an antenna array, a microstrip feed line, and one or more microstrip parasitic patches. The antenna array includes a plurality of microstrip E-shaped patch antennas laminated on an upper surface of the antenna substrate and disposed in a row at predetermined intervals along a power feeding direction. Here, each of the predetermined intervals is substantially equal to the effective wavelength $\lambda_{eff}$ at a dielectric constant of a medium. The microstrip feed line is laminated on an upper surface of the antenna substrate and configured to serially connect the plurality of microstrip E-shaped patch antennas so that serial feeding is performed. The one or more microstrip parasitic patches are laminated on the upper surface of the antenna substrate and disposed in empty areas between the plurality of microstrip E-shaped patch antennas so as to be co-polarized with the plurality of microstrip E-shaped patch antennas without causing an increase in the overall antenna area. The one or more microstrip parasitic patches are symmetrically disposed in two rows on the left and right sides with respect to the microstrip feed line. A length $L_0$ of each of the plurality of microstrip E-shaped patch antennas is determined by $L_0=\lambda_{eff}/2$, and the length $L_P$ of each of the microstrip parasitic patches in the feed direction is determined by $L_P<\lambda_{eff}/2$.

In exemplary embodiments of the present invention, the one or more microstrip parasitic patches may be co-polarized with the plurality of microstrip E-shaped patch antennas so that current flows in the one or more microstrip parasitic patches have the same polarity, i.e., the same phase as current flows in the plurality of microstrip E-shaped patch antennas.

In the exemplary embodiments of the present invention, each of the plurality of microstrip E-shaped patch antennas may have an E-shaped structure in which two rectangular notches are formed in the feed side edges of rectangular microstrip patches on right and left sides of the microstrip feed line.

In exemplary embodiments of the present invention, a resonance frequency $f_0+\Delta f$ of each of the one or more microstrip parasitic patches may be higher than a resonance frequency $f_0$ of the plurality of microstrip E-shaped patch antennas.

The parasitic patches added between the E-shaped patch antennas according to the present invention are co-polarized with the E-shaped patch antennas so that the current flows in the parasitic patches have the same polarity as the current flows in the E-shaped patch antennas. The parasitic patches can thus function as additional radiating elements, thereby increasing the overall antenna gain. Since the parasitic patches are disposed between the E-shaped patch antennas, there is no increase in the entire area of the series-fed E-shaped patch antenna array due to the addition of the parasitic patches. The parasitic patches can provide an increased gain at a frequency higher than the resonance frequency of the E-shaped patch for a given antenna area. Further, the parasitic patches can increase the aperture efficiency of the antenna. Also, since the parasitic patches compensate for the gain at the high frequency edge, the gain flatness of the microstrip patch antenna array employing them can be increased.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Figure 1:
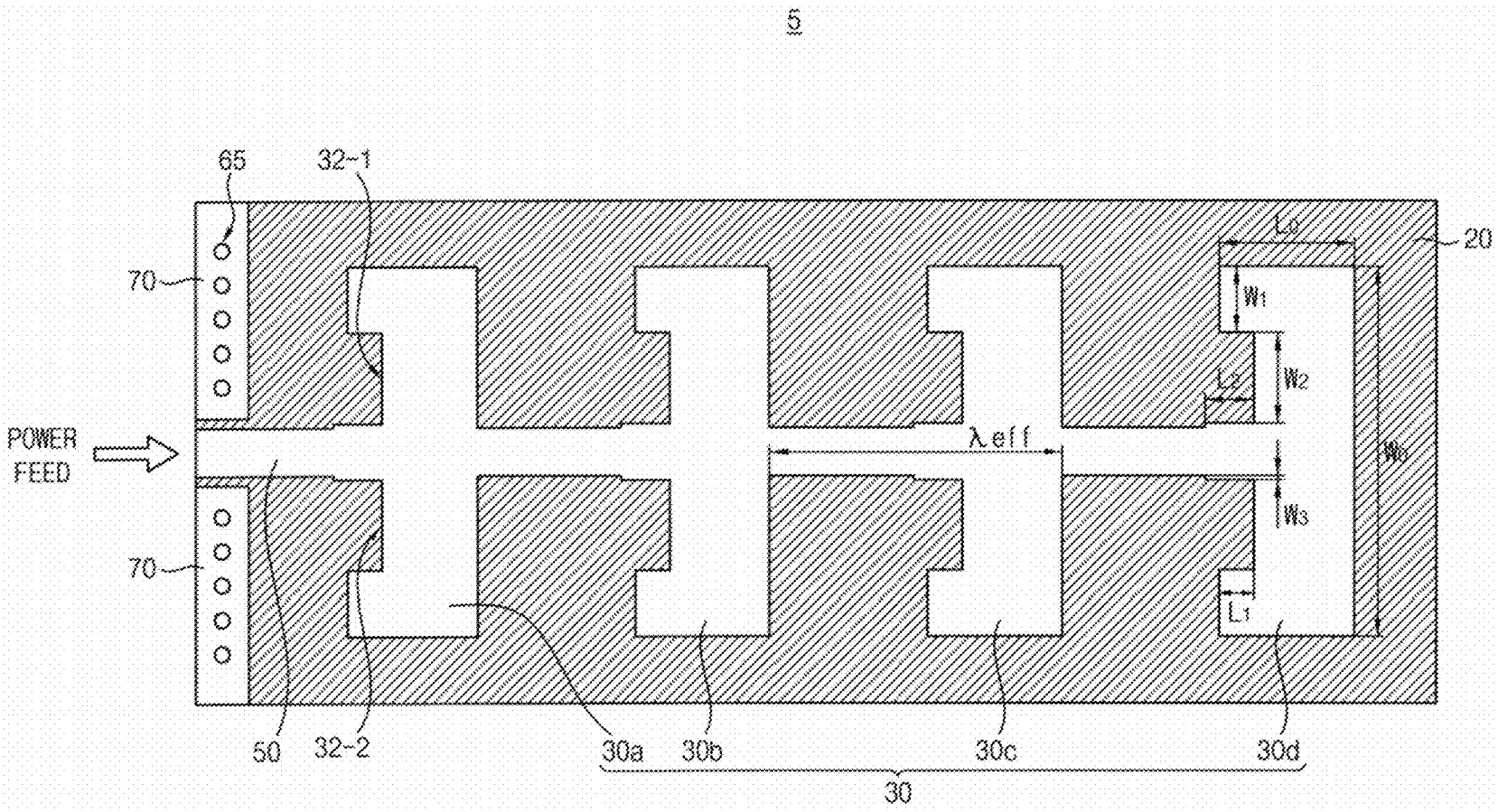
FIG. 1 illustrates a top view of a series-fed E-shaped four-element microstrip patch antenna array without a separate parasitic patch ('a parasitic patch-free type').

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 exemplarily shows a microstrip E-shaped patch antenna array 5 without a parasitic patch added thereto. The patch antenna array 5 is to be compared with a parasitic patch-equipped type E-shaped microstrip patch antenna array 10 with the parasitic patches according to an exemplary example of the present invention shown in FIGS. 2A and 2B to be described later. The microstrip E-shaped patch antenna array 5 without the parasitic patch is different from the parasitic patch-equipped type E-shaped microstrip patch antenna array 10 (Hereinafter, simply referred to as a 'microstrip patch antenna array') in that the former does have no microstrip parasitic patch.

Figure 2A:
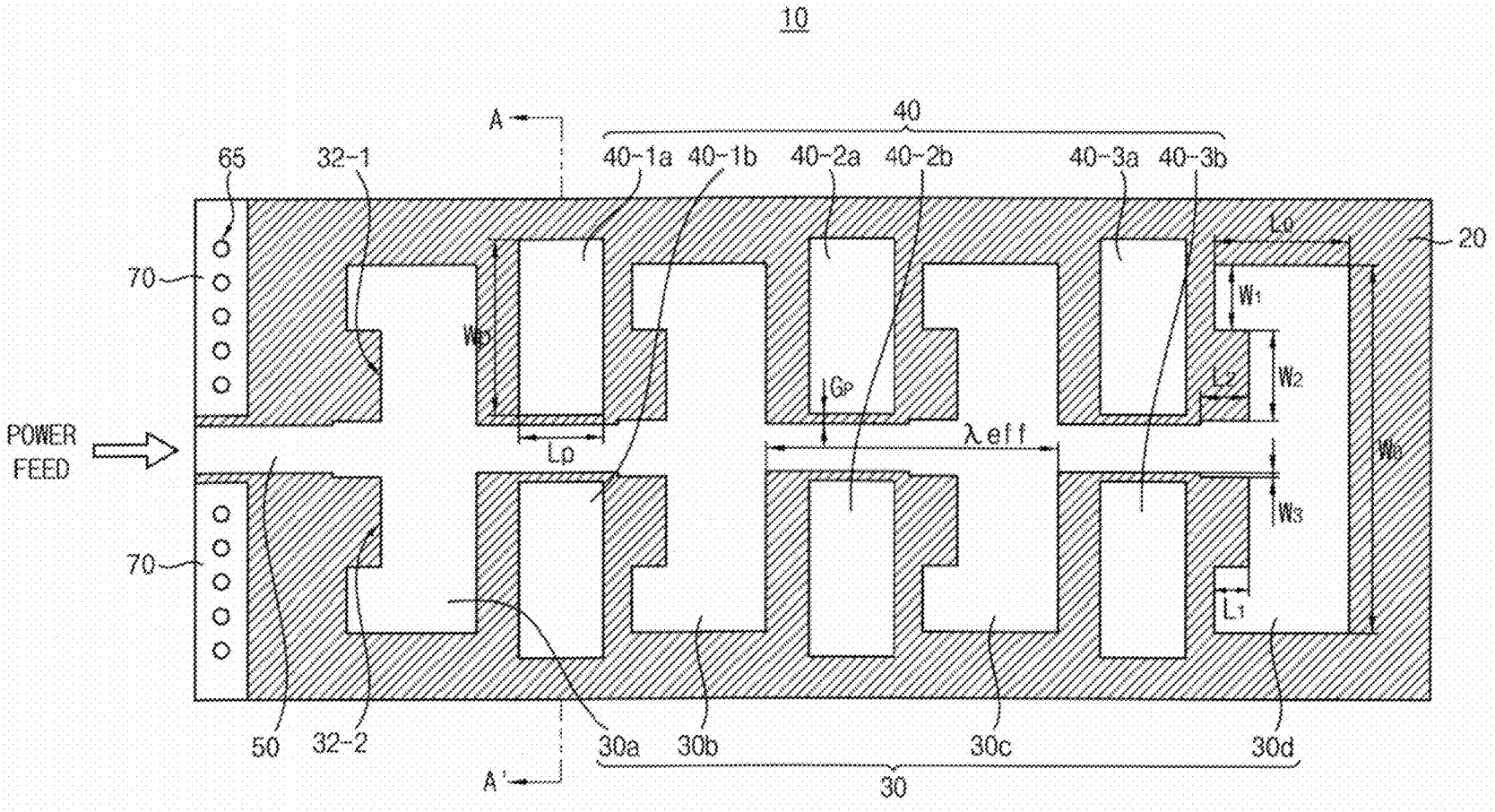
FIG. 2A is a top view of a four-element series-fed E-shaped microstrip patch antenna array with parasitic patches ('a parasitic patch-equipped type') in accordance with an embodiment of the present invention.
Figure 2B:
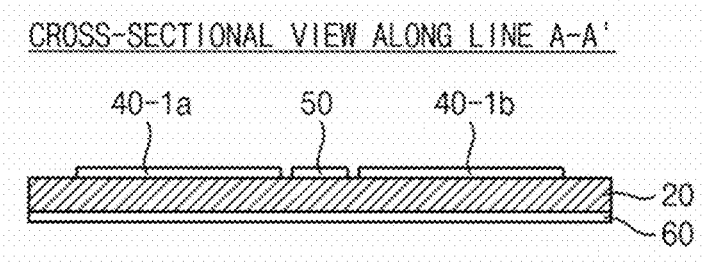
FIG. 2B is a cross-sectional view of the patch antenna array taken along the cutting line A-A' shown in FIG. 2A.

FIG. 2A illustrates a planar layout of the parasitic patch-equipped type series-fed E-shaped microstrip patch antenna array 10 constructed according to an exemplary example of the present invention. FIG. 2B illustrates a cross-sectional view taken along line A-A' of the microstrip patch antenna array 10 shown in FIG. 2A.

The geometric structure of the microstrip patch antenna array 10 will be described with reference to FIGS. 2A and 2B. The microstrip patch antenna array 10 according to the exemplary example of the present invention is characterized in that it has a structure in which a parasitic patch 40 is added to the microstrip E-shaped patch antenna array 5 shown in FIG. 1.

The microstrip patch antenna array 10 may include a dielectric antenna substrate 20, an antenna array 30, one or more microstrip parasitic patches 40, and a serial feed line 50. The antenna array 30, the one or more microstrip parasitic patches 40, and the serial feed line 50 are laminated on the upper surface of the antenna substrate 20. A microstrip ground plate 60 may be laminated on the bottom surface of the antenna substrate 20.

The patch antenna array 10 may be provided in the form of a microstrip patch antenna array for a single layer design. According to an exemplary embodiment, the antenna substrate 20 may be a single-layer dielectric substrate made of a material having a high dielectric constant.

For a wide frequency bandwidth, the antenna array 30 of the microstrip patch antenna array 10 may include a plurality of E-shaped patch antennas. The illustrated antenna array 30 includes four E-shaped patch antennas 30*a*, 30*b*, 30*c*, and 30*d*, but the present invention is not limited thereto and may include other number of E-shaped patch antennas. Each of the microstrip E-shaped patch antennas 30*a*, 30*b*, 30*c* and 30*d* is formed with two rectangular notches 32-1 and 32-2 into the feed side edges of the rectangular patches on the right and left sides of the microstrip serial feed line 5, respectively. They are arranged in the form of an E-shaped.

The E-shaped patch antennas 30*a*, 30*b*, 30*c*, and 30*d* may be laminated on the upper surface of the antenna substrate 20, and may be arranged at predetermined intervals along a power feed direction. According to an exemplary embodiment, the spacing between the E-shaped patch antennas 30*a*, 30*b*, 30*c* and 30*d* in the power feed direction (the y-axis direction in FIG. 1), that is, the spacing between corresponding points of the plurality of microstrip E-shaped patch antennas 30*a*, 30*b*, 30*c*, and 30*d* in the power feed direction may be equal to the effective wavelength $\lambda_{eff}$ at the dielectric constant of the medium so that all radiation elements are in-phase.

According to an exemplary embodiment, the microstrip feed line 50 is laminated on the upper surface of the antenna substrate 20, and connects the plurality of E-shaped patch antennas 30*a*, 30*b*, 30*c*, and 30*d* in series so that it can feed the respective E-shaped patch antennas 30*a*, 30*b*, 30*c*, and 30*d* in series.

According to an exemplary embodiment, the one or more microstrip parasitic patches 40 may also be laminated on upper surface of the antenna substrate 20 for area efficiency and gain flatness over a wideband.

In an exemplary embodiment, the one or more microstrip parasitic patches 40 may be positioned within an area of a plurality of microstrip E-shaped patch antennas 30*a*, 30*b*, 30*c*, and 30*d* without causing an increase in the overall area of the microstrip patch antenna array 10 and such that the microstrip parasitic patches 40 can be co-polarized with the microstrip E-shaped patch antennas 30*a*, 30*b*, 30*c*, and 30*d*.

Specifically, according to an exemplary embodiment, the microstrip parasitic patches 40 may include one or more microstrip parasitic patches. FIG. 2A illustrates a case that the microstrip parasitic patches 40 includes three pairs of microstrip parasitic patches 40-1*a*, 40-1*b*, 40-2*a*, 40-2*b*, 40-3*a*, and 40-3*b*. These microstrip parasitic patches 40-1*a*, 40-1*b*, 40-2*a*, 40-2*b*, 40-3*a*, and 40-3*b* may be disposed in the empty areas between the microstrip E-shaped patch antennas 30*a*, 30*b*, 30*c*, 30*d*. Since the microstrip parasitic patches 40 are disposed in the empty areas, the size of the entire antenna area is not increased due to the addition of the microstrip parasitic patches 40.

According to an exemplary embodiment, the microstrip parasitic patches 40 may be arranged in two rows along the microstrip feed line 50 in the same area as the original antenna area. That is, the microstrip parasitic patches 40 may include a plurality of microstrip parasitic patches 40 symmetrically arranged in two rows, one row on each side of the microstrip feed line 50.

With this arrangement, the plurality of microstrip parasitic patches 40 can be co-polarized with the plurality of microstrip E-shaped patch antennas 30*a*, 30*b*, 30*c*, and 30*d*. Accordingly, the current flow in the plurality of microstrip parasitic patches 40 can be the same polarity as the current flow in the plurality of microstrip E-shaped patch antennas 30*a*, that is, these current flows can be in phase.

According to an exemplary embodiment, the length $L_0$ in the power feeding direction (y-axis direction) of each of the plurality of microstrip E-shaped patch antennas 30*a*, 30*b*, 30*c*, and 30*d* may be determined by $L_0=\lambda_{eff}/2$. The length $L_P$ in the power feeding direction of each of the plurality of microstrip parasitic patches 40-1*a*, 40-1*b*, 40-2*a*, 40-2*b*, 40-3*a*, and 40-3*b* may be determined by $L_P<\lambda_{eff}/2$.

According to an exemplary embodiment, a Taconic TLY-5 substrate having a thickness of 0.25 mm, a dielectric constant $\varepsilon_r$ of 2.2, and a metal layer thickness t of 18 μm can be used as the antenna substrate 20. The interval between the plurality of microstrip E-shaped patch antennas 30*a*, 30*b*, 30*c*, and 30*d* may be determined such that all of the radiation elements of the antenna array 10 are in the same phase. For example, the interval may be equal to an effective wavelength $\lambda_{eff}$, which may be for example 3.27 mm, when the dielectric constant $\varepsilon_r$ of the antenna substrate is 2.2. When the wavelength $\lambda_o$ is determined by the equation of $\lambda_o=c/f_o$ at the frequency of $f_o$ in the air, the effective wavelength $\lambda_{eff}$ in a medium having its dielectric constant of $\varepsilon_r$ is determined by the equation of $\lambda_{eff}=c/(f_o \cdot \varepsilon_r)$.

Table 1 shows an example of optimized dimensions of the antenna array, that is, the optimized values of the various parameters shown in FIG. 2.

TABLE 1

| Parameter | Value (mm) | Parameter | Value (mm) |
|---|---|---|---|
| $W_0$ | 4.4 | $L_0$ | 1.55 |
| $W_1$ | 0.79 | $L_1$ | 0.4 |
| $W_2$ | 1.06 | $L_2$ | 0.58 |
| $W_3$ | 0.06 | $\lambda_{eff}$ | 3.27 |
| $W_p$ | 2.1 | $G_g$ | 0.13 |
| $G_p$ | 0.1 | $L_p$ | 1.2 |

Next, the physical characteristics in the design of the co-polarized microstrip parasitic patches 40 and the series-fed E-shaped patch antenna array are described below.

Figure 3:
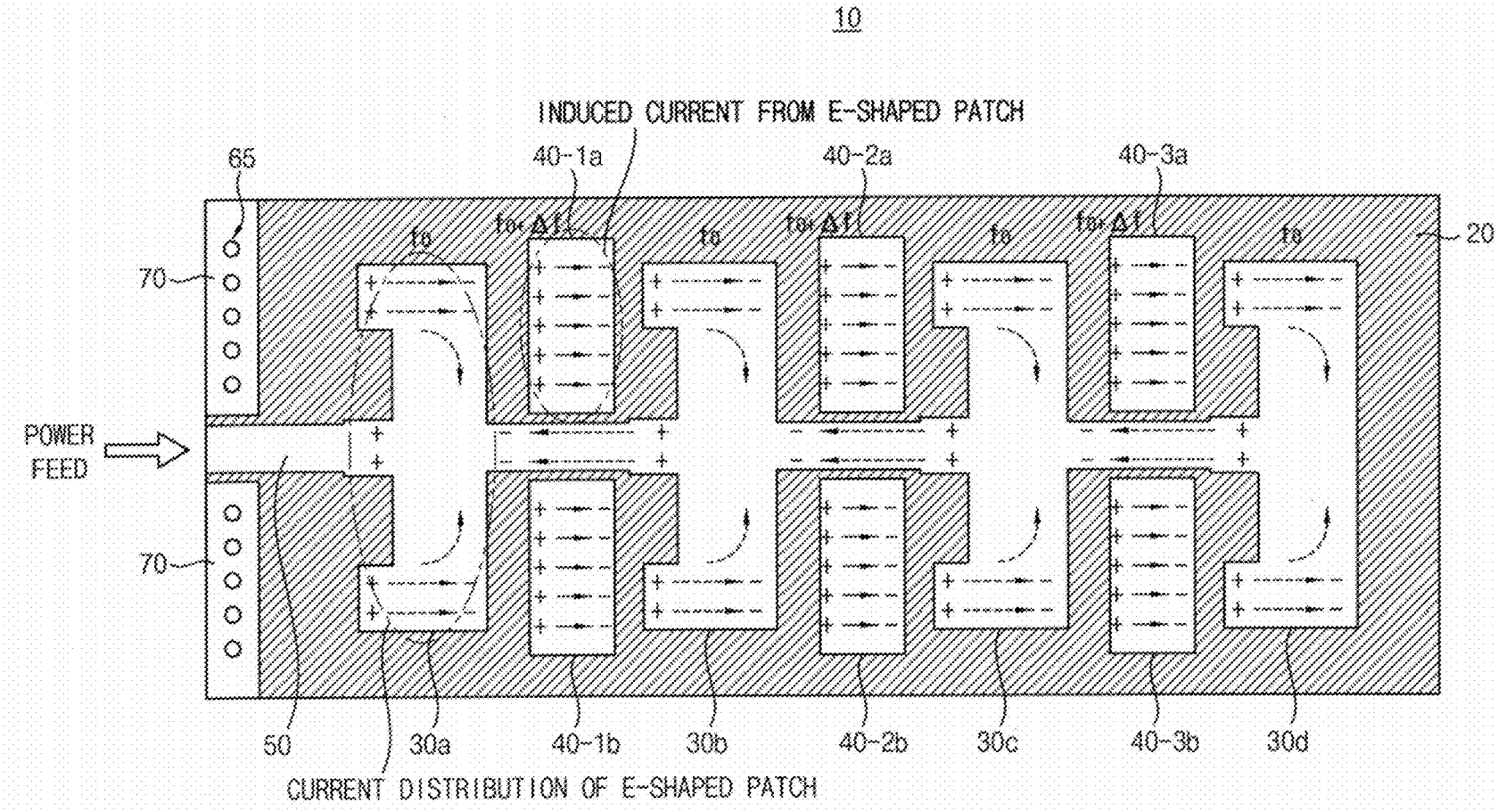
FIG. 3 shows current and charge distribution of the four-element series-fed E-shaped microstrip patch antenna array with co-polarized parasitic patches in the patch antenna array shown in FIG. 2A.

FIG. 3 illustrates current and charge distribution of the microstrip four-element E-shaped patch antennas 30*a*, 30*b*, 30*c*, and 30*d* and the microstrip parasitic patches 40 co-polarized with the E-shaped patch antennas 30*a*, 30*b*, 30*c*, and 30*d* in the microstrip patch antenna array 10 shown in FIG. 2A.

With reference to FIG. 3, when the parasitic patches 40 are present, the currents flowing through the respective parasitic patches 40-1*a*, 40-1*b*, 40-2*a*, 40-2*b*, 40-3*a*, and 40-3*b* may be induced by the respective E-shaped patch antennas 30*a*, 30*b*, 30*c*, and 30*d*, and the microstrip power feed line 50 connecting them in series. The induced currents may have the same phase (the same polarity) as the currents flowing in the respective E-shaped patch antennas 30*a*, 30*b*, 30*c*, and 30*d*. With the addition of the parasitic patches 40, the overall antenna gain can be increased while maintaining the same physical area of the antenna array. If the currents flowing in the parasitic patches 40 do not have the same phase as the currents flowing in the E-shaped patch antenna 30*a*, 30*b*, 30*c*, and 30*d*, the antenna gain may not be increased, and side-lobe characteristics of the antenna array 10 may be deteriorated. The side-lobe becomes larger and the antenna gain in the desired direction cannot be enhanced.

The addition of the microstrip parasitic patches 40 can also lead to an increase in aperture efficiency of the antenna. When power is fed through the microstrip feed line 50, each of the E-shaped patch antenna 30*a*, 30*b*, 30*c*, 30*d* may be resonant at the frequency of $f_0$ (in an exemplary example $f_0$ may be 60 GHz), and positive ('+') and negative ('−') charges may be formed at the edges of the E-shaped patch antennas 30*a*, 30*b*, 30*c* and 30*d* as shown in FIG. 3. Thus, in each of the microstrip parasitic patches 40-1*a*, 40-1*b*, 40-2*a*, 40-2*b*, 40-3*a*, and 40-3*b*, positive ('+') charges may be formed at the first edge portion near the power feed point and negative ('−') charges may be formed at the second edge portion opposite to the first edge portion and far from the power feed point. With this charge induction, an induced current can flow in the power feeding direction, that is, in the y-axis direction in each of the microstrip parasitic patches 40. The returning current flows through the respective parasitic patches 40 may be also induced to have the same polarity by the power feed line 50.

Since the length $L_p$ of each of the microstrip parasitic patches 40 may be shorter than the length $L_0$ of each of the E-shaped patch antennas 30*a*, 30*b*, 30*c* and 30*d*, the resonance frequency $f_0+\Delta f$ is higher than the resonance frequency $f_0$ of each of the E-shaped patch antennas 30*a*, 30*b*, 30*c*, and 30*d*. Thus, adding the parasitic patches 40 to the E-shaped patch antennas 30*a*, 30*b*, 30*c* and 30*d* may induce an increased gain at frequencies higher than the resonance frequency of the E-shaped patches for a given antenna area.

Figure 4:
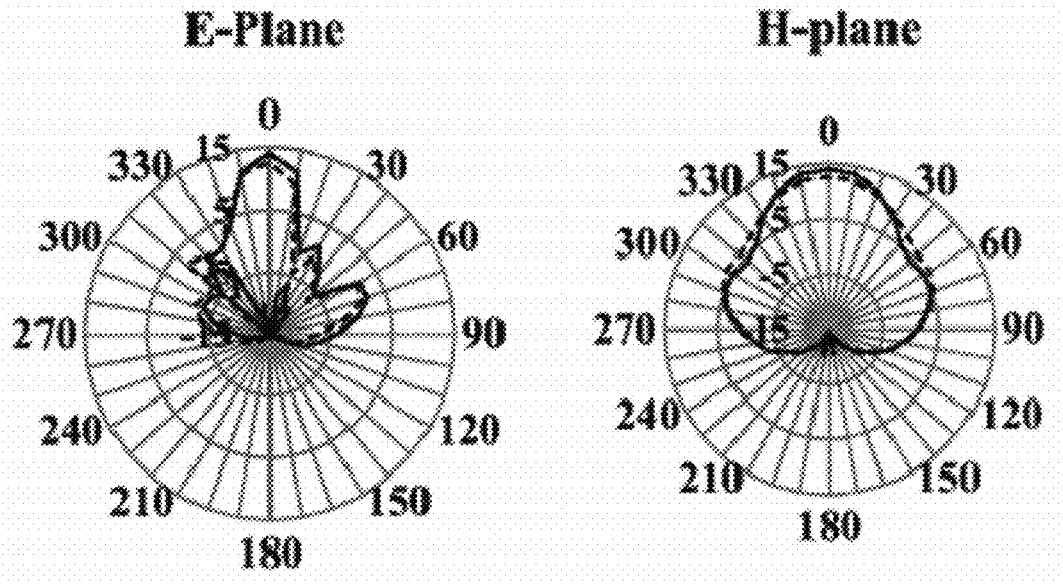
FIG. 4 shows simulated radiation patterns of the four-element series-fed E-shaped microstrip patch antenna array with and without the parasitic patches for 64 GHz (solid line: parasitic patch-equipped type, and dotted line: parasitic patch-free type)

Also, because the parasitic patches 40 compensate for the gain at the high frequency edge, the microstrip patch antenna array 10 employing them can have increased gain flatness. FIG. 4 illustrates simulated radiation patterns of the four-element series-fed E-shaped microstrip patch antenna array with the parasitic patches as shown in FIG. 2A and without the parasitic patches as shown in FIG. 1 (solid line: parasitic patch-equipped type, and dotted line: parasitic patch-free type). The radiation patterns correspond to a case where a signal having a frequency of for example 64 GHz is fed in series to the four E-shaped patch antennas 30*a*, 30*b*, 30*c*, and 30*d* through the microstrip feed line 50.

Referring to the simulation results shown in FIG. 4, the simulated half power beam widths (HPBW) of the microstrip patch antenna array 10 with the parasitic patches 40 and the microstrip patch antenna array 5 without parasitic patches are 20° and 22° respectively in the E-plane and 44° and 56° respectively in the H-plane. The peak gains of the microstrip patch antenna array 10 with the parasitic patches 40 and the microstrip patch antenna array 5 without parasitic patches are 14.0 dBi and 12.6 dBi, respectively. The HPBWs in the E-plane and H-plane are thus reduced by adding parasitic patches 40 because parasitic patches 40, which serve as additional radiating elements, are added to the series-fed E-shaped microstrip patch antenna array 5.

Figure 5:
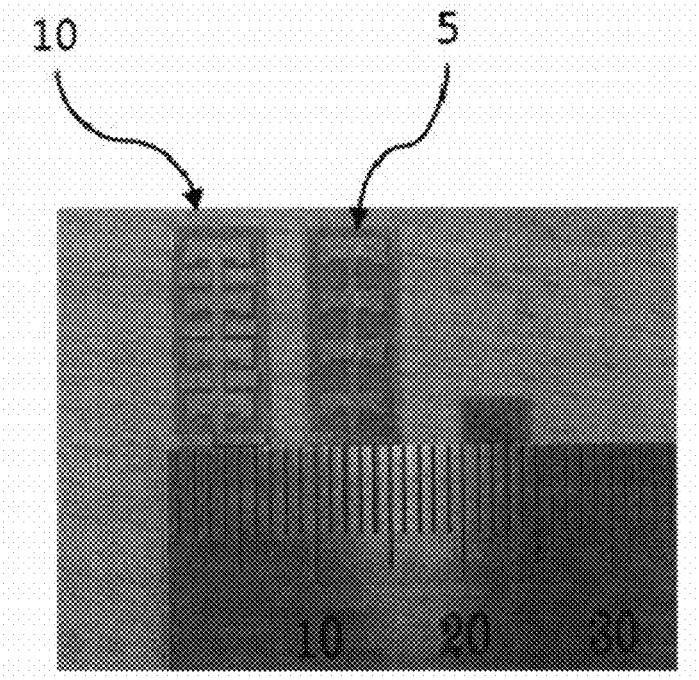
FIG. 5 is a photograph of a four-element series-fed E-shaped microstrip patch antenna array with the parasitic patches fabricated as a prototype according to an embodiment of the present invention.

FIG. 5 is a photograph showing actually manufactured prototype products of the microstrip patch antenna array 10 with the parasitic patches 40 and the microstrip patch antenna array 5 without the parasitic patches. The overall dimension of these patch antenna arrays 5 and 10 is, for example, 14.7×6.0×0.25 $mm^3$ in the length, width, and height. In order to directly test the effect according to the present invention, various measurements were conducted with the two antenna arrays 5 and 10 shown in FIG. 5. For the measurement of each of the two antenna arrays 5 and 10, a conductor pad 70 was laminated on the power feed side edge of the upper surface of the antenna substrate 20 and made to be electrically connected to the ground plate 60 on the bottom surface of the antenna substrate 20 via a via holes 65. In the actual measurement, a ground-signal ground (GSG) probe was used. Used was the antenna test equipment capable of measuring the radiation angles from −40° to 120° for the E-plane and −70° to 70° for the H-plane.

Figure 6:
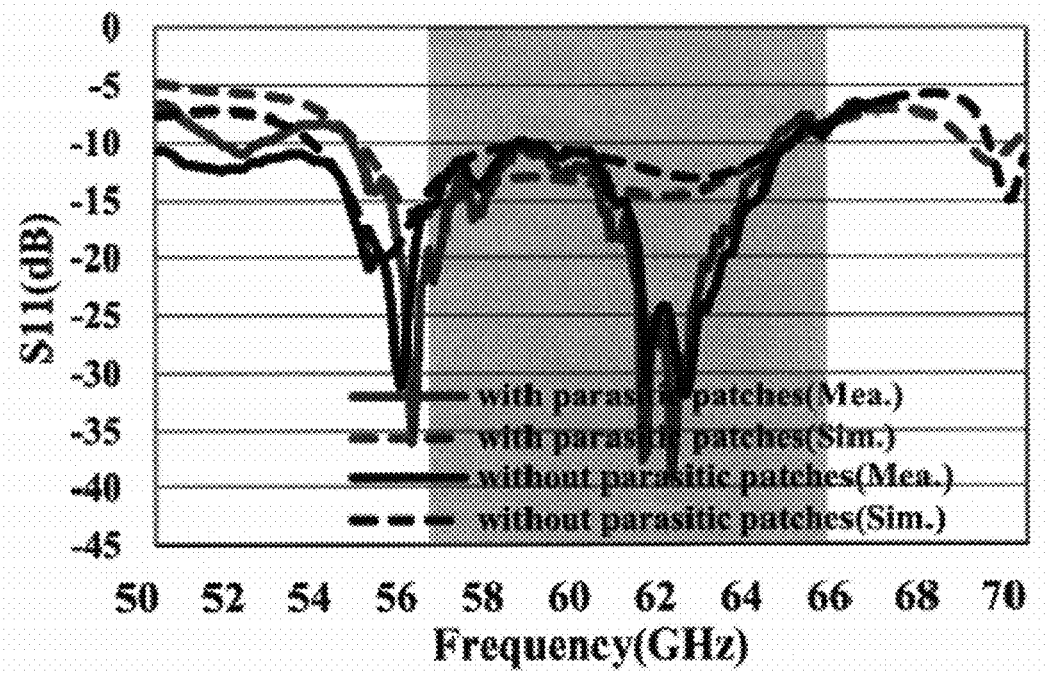
FIG. 6 shows simulated $S_{11}$ and measured $S_{11}$ of four-element series-fed E-shaped microstrip patch antenna arrays with and without the parasitic patches.

FIG. 6 shows the simulated $S_{11}$ value and the actually measured $S_{11}$ value of the microstrip patch antenna array 10 with the parasitic patches 40 and the microstrip patch antenna array 5 without parasitic patch, respectively. In the graph of FIG. 6, the solid line represents the actual measurement value, and the dotted line represents the simulation value. The red graph relates to a microstrip patch antenna array 10 with the parasitic patches 40 and the black graph relates to the microstrip patch antenna array 5 without the parasitic patches.

The measured impedances of the microstrip patch antenna array 10 with the parasitic patches 40 and the microstrip patch antenna array 5 without parasitic patch are 25.4% (50 GHz to 64.6 GHz) and 21.7% (51.5 GHz to 64.1 GHz), respectively. Since the added parasitic patch 40 resonates at a frequency $f_0+\Delta f$ higher than the resonance frequency $f_0$ of the E-shaped patch antennas 30*a*, 30*b*, 30*c* and 30*d*, the impedance bandwidth is slightly reduced but its impedance bandwidth covers the 60 GHz band by increasing the low frequency edge of the impedance bandwidth.

Figure 7:
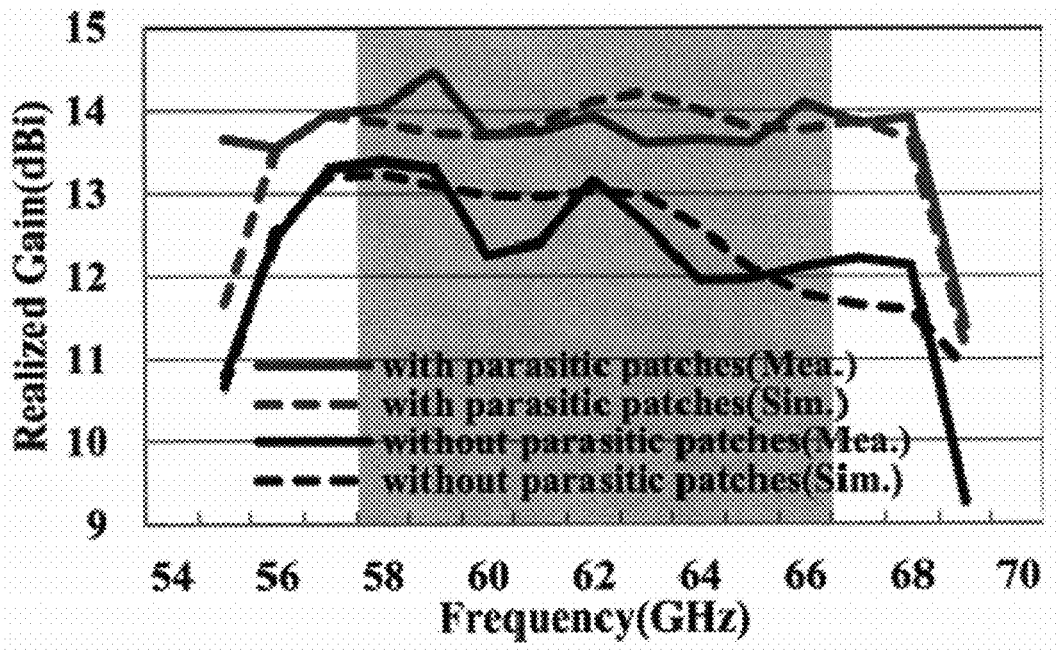
FIG. 7 shows a simulated gain and a measured gain of the four-element series-fed E-shaped microstrip patch antenna arrays with and without the parasitic patches.

FIG. 7 shows simulated gain values and measured gain values of the microstrip patch antenna array 10 with the parasitic patches 40 and the microstrip patch antenna array 5 without parasitic patch, respectively. Similar to FIG. 6, the solid line in the graph of FIG. 7 represents the actual measurement value, and the dotted line represents the simulation value. The red graph relates to the microstrip patch antenna array 10 with the parasitic patches 40 and the black graph relates to the microstrip patch antenna array 5 without parasitic patch.

Referring to FIG. 7, the maximum gain at 57 GHz of the microstrip patch antenna array 5 without parasitic patch was measured to be 13.4 dBi, and the gain varies by 1.4 dB within the unlicensed bandwidth of 60 GHz between 57 GHz and 66 GHz. In the case of the microstrip patch antenna array 10 with the parasitic patches 40, the peak gain was measured to be 14.5 dBi at 59.5 GHz and it shows a very small flat gain of 0.8 dB over the unlicensed bandwidth of 60 GHz. The gain is increased by the parasitic patches 40 due to the additional radiation from the parasitic patch 40. Radiation from the parasitic patches 40 designed to be resonant at 67 GHz also flattens the gain deviation by compensating for the gain reduction at the high end of the band.

Figure 8:
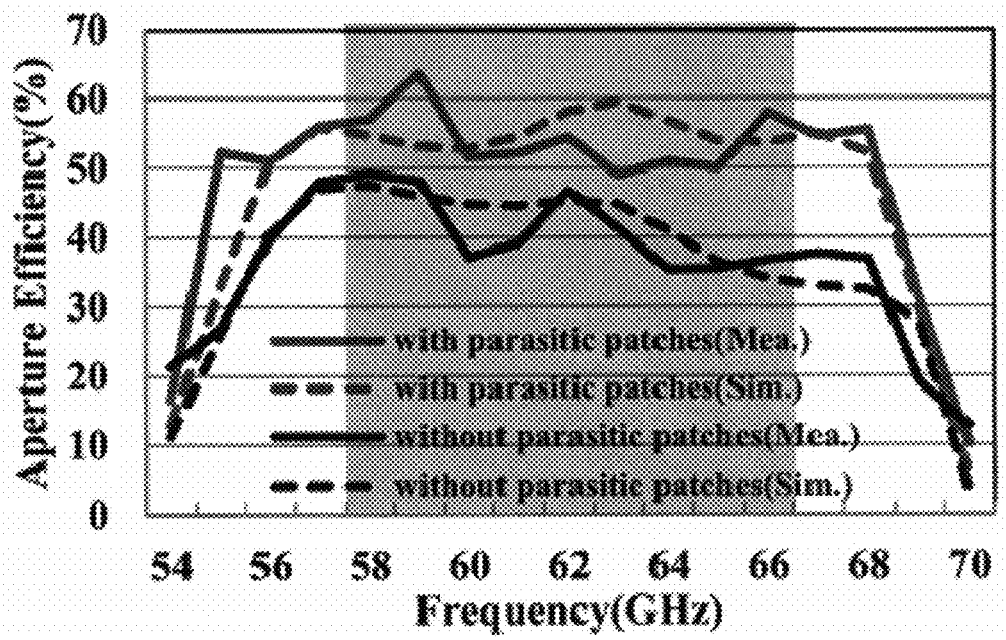
FIG. 8 shows the calculated aperture efficiency of the four-element series-fed E-shaped microstrip patch antenna arrays with and without the parasitic patches.

FIG. 8 shows the calculated aperture efficiencies of the microstrip patch antenna array 10 with the parasitic patches 40 and the microstrip patch antenna array 5 without parasitic patch, respectively. Similar to FIG. 6, the solid line in the graph of the drawing represents the actual measured value, and the dotted line represents the simulation value. The red graph relates to the microstrip patch antenna array 10 with the parasitic patches 40 and the black graph relates to the microstrip patch antenna array 5 without parasitic patch.

The aperture efficiency $A_{aperature}$ can be calculated by the following equation (1). The calculated aperture efficiency is shown in FIG. 8.

$$A_{aperture} = \frac{A_{em}}{A_p} = \frac{G_0 \frac{\lambda_0^2}{4\pi}}{A_p} \quad (1)$$

Here, $A_p$ (14.7×6 mm$^2$ for 4-elements) and $A_{em}$ represent a physical area and a maximum effective area, respectively, of the microstrip patch antenna array 10 with parasitic patches 40 according to an exemplary embodiment of the present invention. $\lambda_0$ and $G_0$ represent a free space wavelength and a peak gain of the microstrip patch antenna array 10 at 60 GHz, respectively.

The measured maximum aperture efficiencies of the microstrip patch antenna array 10 with parasitic patches 40 and the microstrip patch antenna array 5 without parasitic patch are 63.6% (59 GHz) and 49.2% (59 GHz), respectively. In can be known that since the microstrip patch antenna array 10 with parasitic patches 40 can have a larger gain than the microstrip patch antenna array 5 without parasitic patch while maintaining the same antenna area as that of the microstrip patch antenna array 5 without the parasitic patch, the aperture efficiency can be improved by the addition of the parasitic patches 40.

Figure 9:
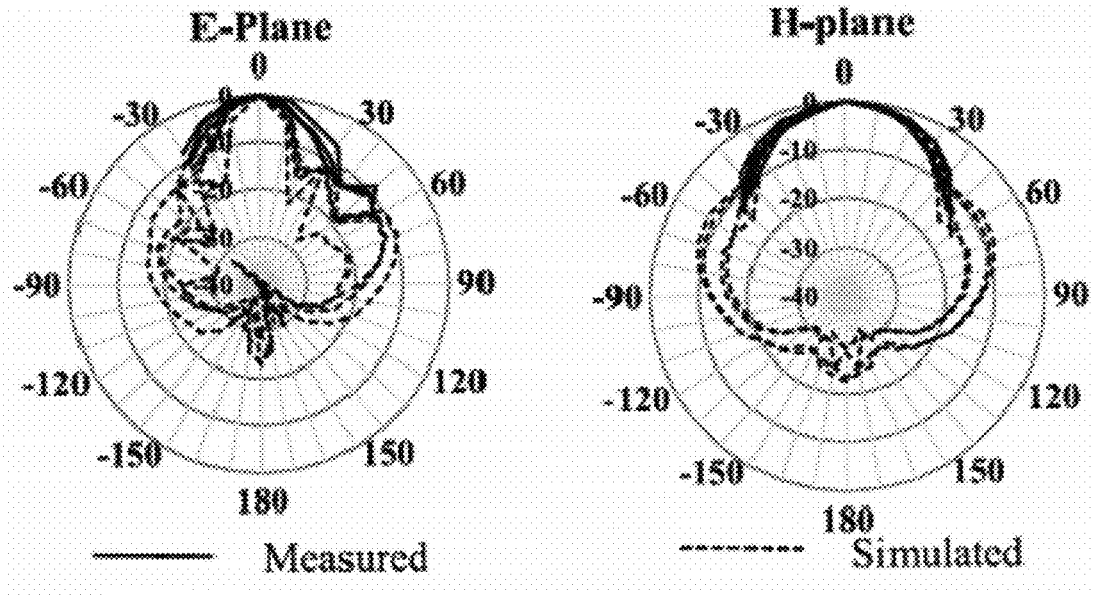
FIG. 9 shows a simulated radiation pattern and a measured radiation pattern, which are superimposed, for a microstrip patch antenna array having parasitic patches.

FIG. 9 shows a simulated radiation pattern and a measured radiation pattern, which are superimposed, for the microstrip patch antenna array 10 having the parasitic patches 40. In the unlicensed band of 60 GHz, the measured HPBW is 20 deg±2.5 deg for the E-plane and 40 deg±10 deg for the H-plane. The discrepancy between the simulated radiation pattern and the measured radiation pattern may be the result of the horn antenna sensing the radiated field reflected from the probe or other measurement system, which results in a distorted measured gain of the E-plane.

As discussed above, the series-fed E-shaped microstrip patch antenna array 10 with co-polarized parasitic patches 40 has a broadband aperture efficiency by the co-polarization for a 60 GHz unlicensed frequency band, for example. The co-polarized parasitic patches 40 that resonate at higher frequencies than the E-shaped patch antennas 30*a*, 30*b*, 30*c* and 30*d* can increase the gain of the antenna for the same antenna area. This improves the gain flatness and aperture efficiency. The E-shaped 4-element patch antenna array has a gain flatness of 0.8 dB, a peak gain of 14.5 dBi, and an aperture efficiency of 63.6% in the entire frequency band of 57 to 66 GHz when the parasitic patches 40 are employed. In contrast, in the case that no parasitic patch is employed, the antenna has a gain flatness of 1.4 dB, a peak gain of 13.4 dBi, and an aperture efficiency of 49.2%. The antenna array having the parasitic patch has better characteristics than the antenna array not having the parasitic patch for respective evaluation items. The antenna size does not change in both antennas with and without the parasitic patch.

The structural characteristics and performance of the antenna disclosed by the exemplary embodiments of the present invention and other array antennas for 60 GHz applications are summarized in Table 2. In Table 2, $\lambda_0$ represents a wavelength in a free space of 60 GHz, and values indicated by '**' are values estimated from the graph.

TABLE 2

| Antenna Type | Impedance Bandwidth | Peak Gain (dBi) | 1-dB Gain Bandwidth | 3-dB Gain Bandwidth | Antenna Size | Peak Aperture Efficiency |
|---|---|---|---|---|---|---|
| Dual resonant slot and patch | 23% | 9 | 5%** | 11.5% | $1.94\lambda_0 \times 1.3\lambda_0 \times 0.22\lambda_0$ | 25.06% |
| Yagi | 9%> | 10 | N/A | N/A | $2.12\lambda_0 \times 1.6\lambda_0 \times 0.152\lambda_0$ | 23.45% |
| L probe patch with soft surface | 29% | 17.5 | 5.1%** | 18.3% | $2.8\lambda_0 \times 2.8\lambda_0 \times 0.2\lambda_0$ | 57.07% |
| Vertical off-center dipole | 17% | 15.6 | 5%** | 15% | $2.94\lambda_0 \times 3.2\lambda_0 \times 0.24\lambda_0$ | 30.71% |
| Dense dielectric patch | 23.7% | 16.5 | 7%** | 32.5% | $5\lambda_0 \times 4\lambda_0 \times 0.31\lambda_0$ | 17.77% |
| Grid array | 19.1% | 17.7 | 3.3%** | 17.6% | $3\lambda_0 \times 3\lambda_0 \times 0.12\lambda_0$ | 52.06% |
| E-shaped patch array with parasitic patches (Present Invention) | 21.7% | 14.5 | 21.2% | 22.5% | $1.2\lambda_0 \times 2.94\lambda_0 \times 0.05\lambda_0$ | 63.6% |

Table 2 shows that the E-shaped patch antenna array with the parasitic patch proposed by the present invention has the smallest profile and the smallest size among other known 60 GHz array antennas, but has the highest 1 dB gain bandwidth and aperture.

The present invention can be used in the field of antenna technology. Especially, it is an effective technology to develop high gain antenna arrays for 60 GHz international unlicensed band with 57-66 GHz bandwidth.

The foregoing is illustrative of example embodiments and is not to be construed as limiting thereof Although a few example embodiments have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims.

What is claimed is:

1. A series-fed E-shaped patch antenna array, comprising:

an antenna substrate comprising a dielectric material;

an antenna array including a plurality of microstrip E-shaped patch antennas laminated on an upper surface of the antenna substrate and disposed in a line at predetermined intervals along a power feeding direction;

a microstrip feed line laminated on the upper surface of the antenna substrate and configured to serially connect the plurality of microstrip E-shaped patch antennas so that serial feeding is performed; and one or more microstrip parasitic patches laminated on the upper surface of the antenna substrate and disposed between the plurality of microstrip E-shaped patch antennas so as to be co-polarized with the plurality of microstrip E-shaped patch antennas.

2. The series-fed E-shaped patch antenna array of claim 1, wherein the one or more microstrip parasitic patches are co-polarized with the plurality of microstrip E-shaped patch antennas so that current flows in the one or more microstrip parasitic patches have the same polarity as current flows in the plurality of microstrip E-shaped patch antennas.

3. The series-fed E-shaped patch antenna array of claim 1, wherein the one or more microstrip parasitic patches are disposed in empty areas between the plurality of microstrip E-shaped patch antennas so as not to cause an increase in the overall antenna area due to placement of the one or more microstrip parasitic patches.

4. The series-fed E-shaped patch antenna array of claim 1, wherein the microstrip parasitic patches are symmetrically disposed in two rows on left and right sides with respect to the microstrip feed line.

5. The series-fed E-shaped patch antenna array of claim 1, wherein the antenna substrate is a single-layer substrate.

6. The series-fed E-shaped patch antenna array of claim 1, wherein each of the plurality of microstrip E-shaped patch antennas has an E-shaped structure in which two rectangular notches are formed in the feed side edges of rectangular microstrip patches on right and left sides of the microstrip feed line.

7. The series-fed E-shaped patch antenna array of claim 1, wherein the predetermined intervals between the plurality of microstrip E-shaped patch antennas are substantially equal to an effective wavelength $\lambda_{eff}$ at a dielectric constant of a medium, wherein a length $L_0$ of each of the plurality of microstrip E-shaped patch antennas is determined by $L_0=\lambda_{eff}/2$, and wherein a length $L_P$ of each of the one or more microstrip parasitic patches in the power feeding direction is determined by $L_P<\lambda_{eff}/2$.

8. The series-fed E-shaped patch antenna array of claim 1, wherein a resonance frequency $f_0+\Delta f$ of each of the one or more microstrip parasitic patches is higher than a resonance frequency $f_0$ of the plurality of microstrip E-shaped patch antennas.

9. The series-fed E-shaped patch antenna array of claim 7, wherein the effective wavelength $\lambda_{eff}$ is determined by an equation of $\lambda_{eff}=c/(f_0\cdot\varepsilon_r)$, where c is light velocity, $f_0$ is frequency in air, and $\varepsilon_r$ is dielectric constant of the medium.

10. The series-fed E-shaped patch antenna array of claim 1, wherein the one or more microstrip parasitic patches provide additional radiation in addition to radiation by the plurality of microstrip E-shaped patch antennas to secure an offset resonance frequency.

11. A series-fed E-shaped patch antenna array, comprising:

an antenna substrate which is made of a dielectric material;

an antenna array including a plurality of microstrip E-shaped patch antennas laminated on an upper surface of the antenna substrate and disposed in a row at predetermined intervals along a power feeding direction;

a microstrip feed line laminated on the upper surface of the antenna substrate and configured to serially connect the plurality of microstrip E-shaped patch antennas so that serial feeding is performed; and one or more microstrip parasitic patches laminated on the upper surface of the antenna substrate and disposed in empty areas between the plurality of microstrip E-shaped patch antennas so as to be co-polarized with the plurality of microstrip E-shaped patch antennas without causing an increase in an overall antenna area, and symmetrically disposed in two rows on left and right sides with respect to the microstrip feed line, wherein each of the predetermined intervals is substantially equal to the effective wavelength $lambda_{eff}$ at a dielectric constant of a medium, and wherein a length $L_o$ of each of the plurality of microstrip E-shaped patch antennas is determined by $L_o=lambda_{eff}/2$, and a length $L_P$ of each of the one or more microstrip parasitic patches in the power feeding direction is determined by $L_P<lambda_{eff}/2$.

12. The series-fed E-shaped patch antenna array of claim 11, wherein the one or more microstrip parasitic patches are co-polarized with the plurality of microstrip E-shaped patch antennas so that current flows in the one or more microstrip parasitic patches have the same polarity as current flows in the plurality of microstrip E-shaped patch antennas.

13. The series-fed E-shaped patch antenna array of claim 11, wherein each of the plurality of microstrip E-shaped patch antennas has an E-shaped structure in which two rectangular notches are formed in the feed side edges of rectangular microstrip patches on right and left sides of the microstrip feed line.

14. The series-fed E-shaped patch antenna array of claim 11, wherein a resonance frequency $f_0+\Delta f$ of each of the one or more microstrip parasitic patches is higher than a resonance frequency $f_0$ of the plurality of microstrip E-shaped patch antennas.

* * * * *